US006101909A

United States Patent [19]

Djie

[11] Patent Number: 6,101,909

[45] Date of Patent: Aug. 15, 2000

[54] ROTARY TOOL

[76] Inventor: Johan Eric Djie, Lauriergracht 108, 1016 RP Amsterdam, Netherlands

[21] Appl. No.: 08/930,983

[22] PCT Filed: Apr. 15, 1996

[86] PCT No.: PCT/NL96/00164

§ 371 Date: Oct. 13, 1997

§ 102(e) Date: Oct. 13, 1997

[87] PCT Pub. No.: WO96/32230

PCT Pub. Date: Oct. 17, 1996

[30] Foreign Application Priority Data

Apr. 13, 1995 [NL] Netherlands ..... 1000140

[51] Int. Cl.[7] ..... B25G 1/01

[52] U.S. Cl. ..... 81/489; 81/177.1; 81/177.5

[58] Field of Search ..... 81/177.1, 177.75, 81/489

[56] References Cited

U.S. PATENT DOCUMENTS 2,487,221 11/1949 Cooke .
3,897,703 8/1975 Phipps ..... 81/177.75
4,262,562 4/1981 MacNeill .
4,330,093 5/1982 Chapman, Jr. .

FOREIGN PATENT DOCUMENTS 3303035 8/1984 Germany .
3742981 7/1989 Germany .
8910673 U 12/1989 Germany .
3918488 12/1990 Germany .

*Primary Examiner*—Timothy V. Eley
*Assistant Examiner*—Willie Berry, Jr.
*Attorney, Agent, or Firm*—Westman, Champlin & Kelly; S. Koehler

[57] ABSTRACT

A rotary tool comprises a longitudinally extending tool part (2) determining the axis of rotation of the tool, and a grip part (1) which is pivotable relative to the tool part (2) about an axis extending substantially perpendicularly to the tool part. The grip part (1), on the side facing away from the tool part and on the end intended to be positioned between thumb and index finger, comprises a knob-shaped support portion (8). A spatial pivot (4, 5) may be arranged between the tool part (2) and the grip part (1).

14 Claims, 4 Drawing Sheets

ROTARY TOOL

The present invention relates to a rotary tool comprising a longitudinally extending tool part determining the axis of rotation of the tool, and a grip part which is pivotable relative to the tool part about an axis extending substantially perpendicularly to the tool part.

Rotary tools, such as screwdrivers, hex keys, socket wrenches etc, are known in various embodiments. In the most widely used embodiment of the screwdrivers, the grip is an extension of the stem of the tool part. Intensive use of such screwdrivers often cause problems in the area of the palm of the hand. Particularly, the carpal tunnel syndrome, in which there is a disorder of the n. medialis, is considered in the medical art as a cause thereof. This is a result of the end of the grip part resting in the palm of the hand precisely on the spot where several nerves extend below. When the tool is rotated a pressure is exerted on the part to be rotated, said pressure eventually arriving in these anatomic structures which, not infrequently, has the result as described above.

There are prior art rotary tools, particularly screwdrivers, e.g. known from U.S. Pat. No. 5,069,091, in which the grip part may rotate relative to the tool part in order to be able to exert a larger torque compared to the normal position in which the grip part is aligned with the tool part. Consequently, one can recognize in such rotary tools a normal position, in which the above problems are caused, and a high torque position.

As will be clear from said patent, the grip part is shaped such that there is still a high load onto the palm of the hand, also in the high torque position.

The object of the invention is to provide a rotary tool of the type mentioned in the preamble, in which said problems are removed in an effective way and which is very favorable in an ergonomical sense.

SUMMARY OF THE INVENTION

For this purpose, the rotary tool according to the invention is characterized in that the grip part, on the side facing away from the tool part and on the end intended to be positioned between thumb and index finger, comprises a knob-shaped support portion. Due to the presence of the knob-shaped support portion between thumb and index finger, it is possible to use the rotary tool both in a "normal", position with the grip part in the extension of or only at a small angle to the tool part, and in the "high torque" position with the grip part at a greater angle to the tool part, and to change without regripping the grip part. As a result, the grip part may be adapted to the hand for this one grip of the hand on the grip part in an ergonomically optimum way. Further, in the "normal" position of the grip part most of the force on the grip part is exerted by the bridge portion of the hand between the thumb and the index finger. This bridge portion is formed by the n. adductor pollicis, which is very suited for absorbing substantial pressures. Consequently, no nerve problems will be caused in this position.

Preferably, the length of the grip part is greater than the width of the hand of a user, which, also in the position for exerting a large torque, prevents pressure on the nerves in the center of the hand, since the grip part rests on the thenar on the thumb side of the hand and on the hypothenar at the little finger side, said thenar and hypothenar have a good pressure resistance. Of course, the side of the grip part facing away from the tool part, within the area which comes to lie between the thenar and the hypothenar, should be fairly flat and surely not convex to prevent a creation of pressure on the palm of the hand. It is of course favorable if the grip part has a smooth even shape, in which the side facing away from the tool part is smoothly concavely arched from the knob-shaped support portion so that there is created more or less a bowl for the bridge portion of the hand between thumb and index finger.

To further improve the rotary tool, the invention proposes to form a spatial pivot between the tool part and the grip part, so that the grip part can not only be pivoted about an axis perpendicularly to the tool part, but also about an axis parallel to the grip part. Such a pivot movement extends the stroke to be made by the tool, particularly when the rotary tool is used above or below the "normal" working height. This results in a more comfortable operation and it requires less strokes to obtain a certain rotation of the part to be rotated. The natural angular rotation of the grip part only has to be small. In order to enhance the stability of the rotary tool it is favorable to arrange this spatial pivot within the grip part.

The invention will further be explained with reference to the sawing showing an embodiment of the rotary tool according to the invention by way of example.

DETAILED DESCRIPTION OF THE ILLUSTRATED EMBODIMENTS

Figure 1:
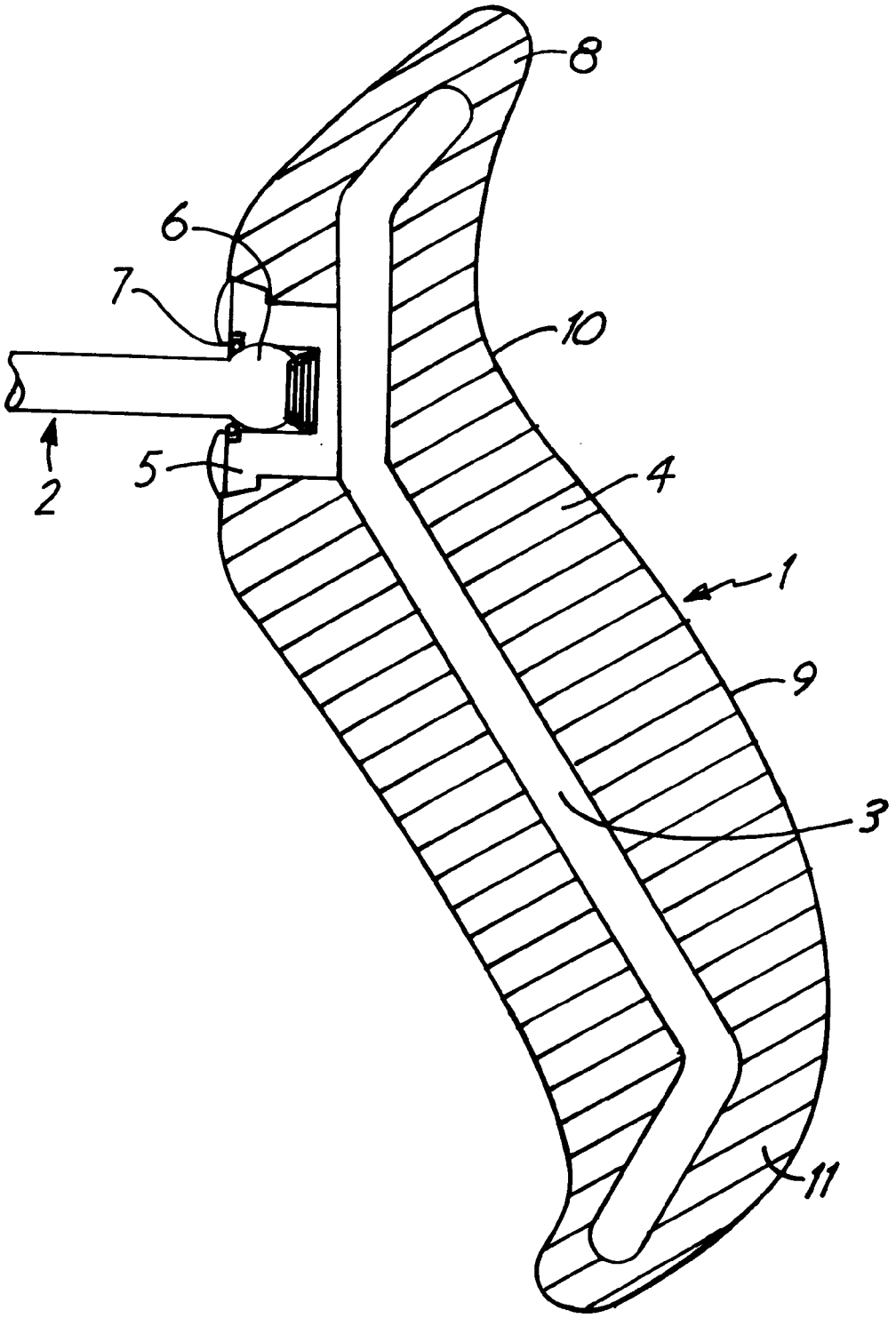
FIG. 1 is a longitudinal view of the rotary tool according to the invention in which the rotary tool is shown for a small par only.

The drawing, and first of all FIG. 1, shows the exemplary embodiment of the rotary tool according to the invention, which comprises a grip part 1 and a co-operating tool part 2. This tool part 2 is shown for a small part in the drawing only, but in this example, it consists of a stem comprising on the front end a screw or bolt engaging means, such as a screwdriver tip, a hex key tip, a socket of a socket wrench etc. It is an advantage if the tool part 2, or possibly even the grip part 1, comprises a reversible one-way coupling (not shown) such as a ratchet mechanism, permitting a transmission of torque to the tip of the tool part 2 in one rotational direction only and permitting a free stroke in the other rotational direction.

In the embodiment shown, the grip part 1 is made of a rigid, e.g. metal core 3, around which an ergonomically shaped casing 4 is molded, preferably of softer plastic, such as a rubber like material, said casing may be adaptive to the shape of the hand of the user. Of course, all kinds of variations are conceivable. For example, the grip part 1 may comprise a covering of soft plastic on specific positions only.

Figure 6:
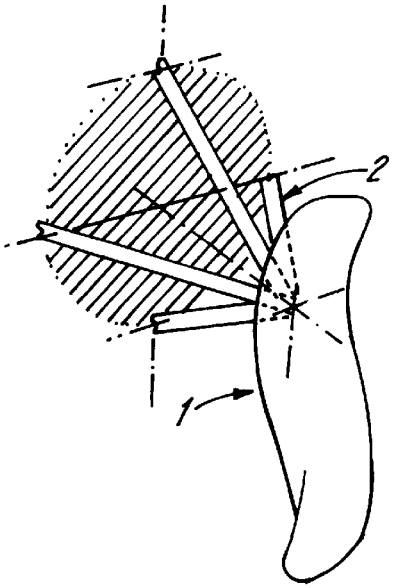
FIG. 6 illustrates in perspective view the relative pivotability between the tool part and the grip part of the rotary tool of FIG. 1.

The rigid core 3 comprises on the front side a hard steel bowl 5 having a hexagon socket, in which a sphere head 6 having an outer hexagon fits, said sphere head 6 being formed on the rear end of the tool part 2 such that the tool part 2 may pivot spatially with respect to the grip part 1 (see FIG. 6), but due to the engagement between the bowl 5 and the hexagonal sphere head 6 it is possible to transmit a torque moment about the axis of rotation determined by the longitudinal axis of the tool part 2. A spring clip 7 retains the sphere head 6 within the bowl 5 in a removable manner or not. It is conceivable to provide a further spring to retain the sphere head within the bowl 5 free of rattling also for a longer time. Due to the illustrated shown position of the bowl 5 within the sphere head 6, the spatial pivot is positioned within the casing 4 of the grip part 1. It is noted that also other spatial pivots are conceivable, such as e.g. a universal joint pivot or another pivot having two non-parallel pivot axes.

Figure 2:
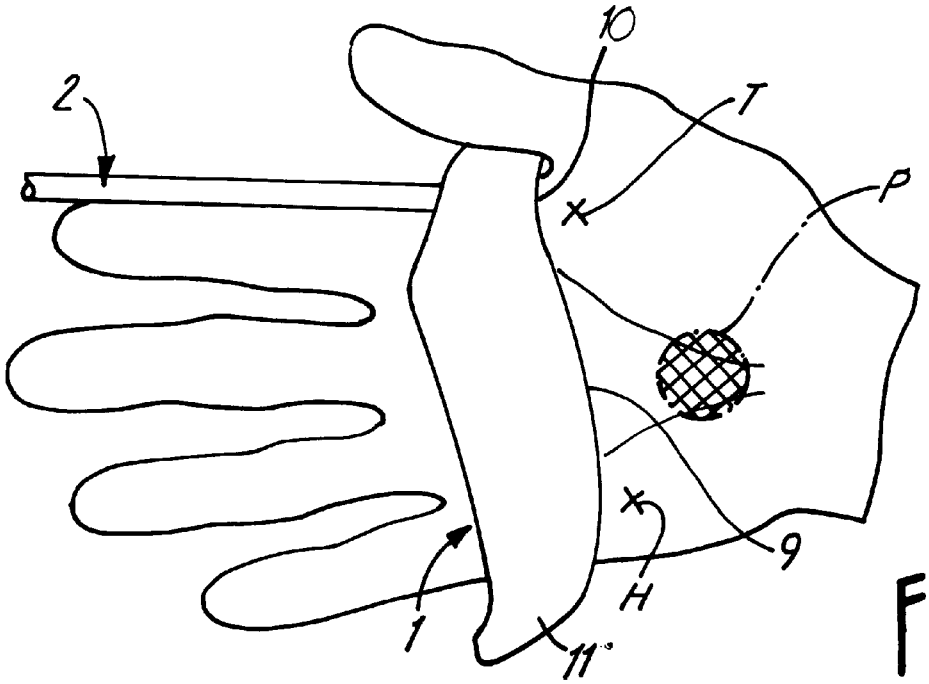
FIGS. 2 and 3 illustrate in perspective view the grip of a hand on the grip part of the rotary tool according to FIG. 1.
Figure 3:
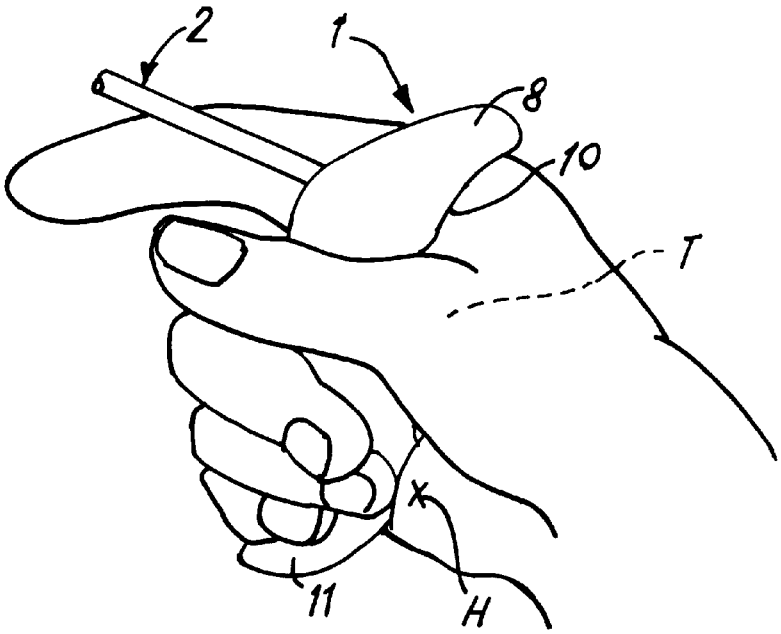

As mentioned, the casing 4 of the grip part 1 has an ergonomic shape. As a first feature, the grip part 1 has on its end that is intended to be positioned between thumb and index finger of a hand, on the side facing away from the tool part 2, a knob-shaped support portion 8. This knob-shaped support portion 8 extends in a direction away from part 2 with respect to the remainder of the grip part 1 and joins smoothly to the central portion 9 of the grip part 1. A transition 10 between the knob-shaped support portion 8 and the central portion 9 is arched concavely and this concave transition 10 is positioned approximately in the area of the bowl 5 of the spatial pivot between the grip part 1 and the tool part 2. The central portion 9 is relatively flat and has such length that the length is generally greater than the distance between thenar T and hypothenar of the hand of a user as illustrated in FIGS. 2 and 3. This causes the side of the grip part 1 facing away from the tool part 2 to form a bridge between this thenar T on the thumb of a hand and the hypothenar H on the little finger side of the hand, in order to bridge the palm portion P of the hand, where a plurality of nerves of the hand meet, and consequently to spare it when the hand exerts force on the grip part 1. An end portion 11 of the grip part 1 tapers slightly towards the side of the tool part 2 in order to form a lower limitation to the fingers. In total, the grip part 1 will generally be longer than the width of a hand.

Figure 4:
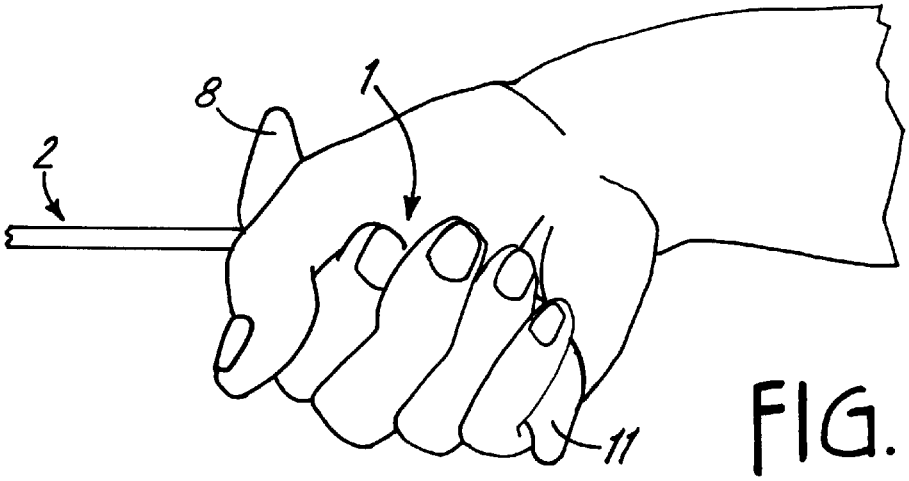
FIGS. 4 and 5 illustrate in perspective view two operational positions of the rotary tool according to FIG. 1.
Figure 5:
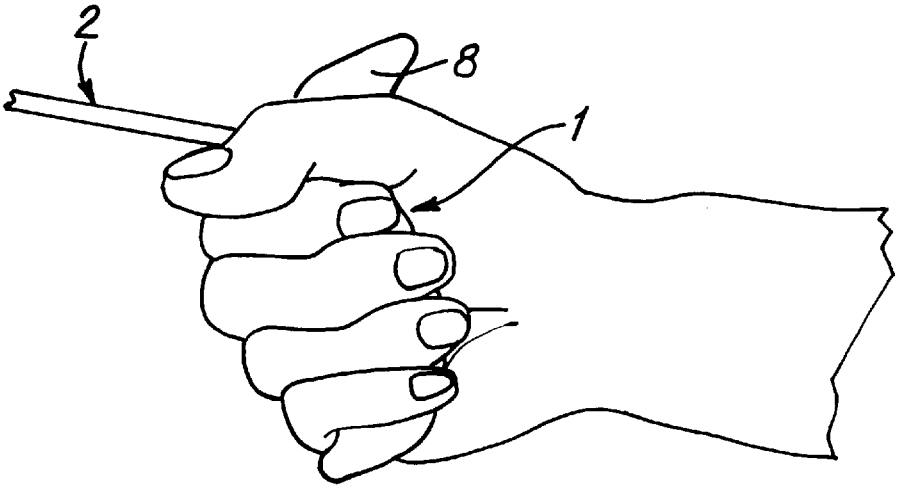

FIGS. 4 and 5 show two positions in which a rotary tool according to the invention may be used. The position of FIG. 4 may be indicated as the "normal" grip position, in which the grip part 1 is positioned as a continuation of or extends only at a small angle to the continuation of the tool part 2 and is comparable to the use of a normal screwdriver or the like. Without regripping the grip portion 1, it can be switched from this normal grip position to the position for exerting additional torque, as is shown in FIG. 5. In this position, one may exert force onto the grip part 1 in positions spaced further from the axis of rotation of the tool part 2. Since the grip part 1 is gripped by the hand in the same manner in both positions, the grip part 1 can be shaped for this one grip only and consequently grip part 1 may be given a shape optimal for this grip. As is illustrated in FIGS. 4 and 5, the line of force in extension of the tool part 2 remains within the wrist joint, so that no torque is caused on the wrist and a pressure force may be exerted on the tool part 2 directly from the forearm. This allows a comfortable and easy use of the rotary tool.

Figure 7:
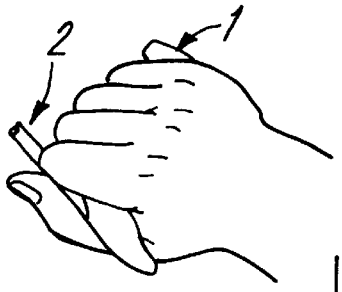
FIGS. 7–9 illustrate in perspective view three positions of a hand when making a rotational stroke with the rotary tool of FIG. 1.
Figure 8:
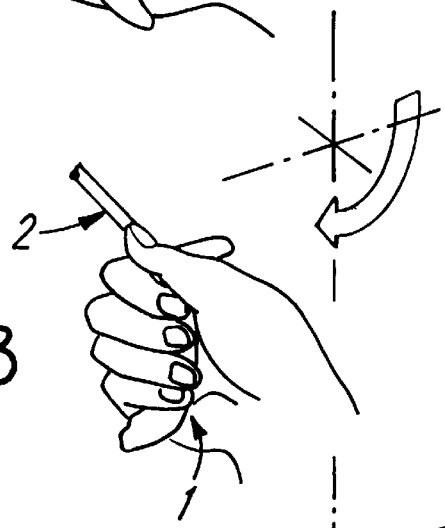
Figure 9:
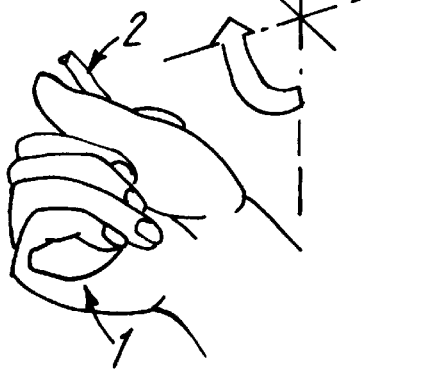

FIGS. 7–9 illustrate the position of the hand and the grip part 1 relative to the tool part 2 in three different positions during the action of a right-hand rotational stroke with the rotary tool according to the invention. It is shown that during the rotation, the grip part 1 pivots and tilts both within the plane through the tool part 2 and the grip part 1 and laterally enabling the hand to take up the optimum position relative to the tool part 2. In addition the lateral rotation of the grip part 1 relative to the tool part 2 enables a greater rotational stroke of the tool part 2, in particular when a user works above or below the normal working height. This results in less strokes needed to tighten or loosen a bolt, screw or the like. This is also the best way to exert torque and pressure force on the tool part 2.

The invention is not restricted to the embodiment shown in the drawing and described herein before which may be varied in different manners within the scope of the invention. E.g., the rotary tool may be provided with an electric drive in one way or another. Further, the possibility exists to provide the tool part in front of the one-way coupling with a connecting means to which all types of tools may be connected in an exchangeable manner. Furthermore it is conceivable to use the invention in glue clamps in which the grip part may be removably connected to different clamping parts through a one-way coupling. As a result, the clamping parts may be clamped onto the work piece close to each other without the hand grips interfering during tightening or loosening.

What is claimed is:

1. A rotary tool comprising:

a longitudinally extending tool part having an axis of rotation; and a grip part connected to and pivotable relative to the tool part, the grip part comprising:

a first end having a knob-shaped support portion adapted to be positioned between a thumb and an index finger of a hand;

a second end remote from the first end;

a first side facing the tool part, wherein the tool part is operably connectable to the first side at a position between the first and second ends; and a second side facing away from the tool part.

2. The rotary tool according to claim 1, wherein the second side facing away from the tool part, includes a concave transition from the knob-shaped support portion to a relatively flat central portion.

3. The rotary tool according to claim 2, wherein the concave transition of the grip part is disposed on a portion of the second side opposite the position of the tool part.

4. The rotary tool according to claim 1, wherein the tool part joins to the grip part proximate the knob-shaped support portion.

5. The rotary tool according to claim 1, wherein a spatial pivot is formed between the tool part and the grip part.

6. Rotary tool according to claim 5, wherein a lateral angular rotation of the grip part relative to the tool part is limited.

7. Rotary tool according to claim 5, wherein the spatial pivot (4, 5) is positioned inside the grip part (1).

8. A rotary tool comprising:

a longitudinally extending tool part having an axis of rotation;

a grip part having a first end adapted to be positioned between a thumb and an index finger of a hand, a second end remote from the first end, a first side facing the tool part and a second side facing away from the tool part; and a spatial pivot joining the tool part to the grip part between the first and second ends.

9. A rotary tool comprising:

a longitudinally extending tool part having an axis of rotation; and a grip part connected to and pivotable relative to the tool part about an axis extending through the grip part, the grip part having a knob-shaped support portion on a side facing away from the tool part and on an end intended to be positioned between thumb and index finger of a hand.

10. The rotary tool of claim 9 wherein the grip part is pivotable about an axis that is perpendicular to the tool part.

11. The rotary tool of claim 10, wherein a spatial pivot is formed between the tool part and the grip part.

12. The rotary tool according to claim 11, wherein the tool part joins to the grip part proximate the knob-shaped support portion.

13. A rotary tool comprising:

a longitudinally extending tool part having an axis of rotation; and a grip part connected to and pivotable relative to the tool part to form varying obtuse angles with the tool part, the grip part having a knob-shaped support portion on a side facing away from the tool part and on an end intended to be positioned between thumb and index finger of a hand.

14. The rotary tool of claim 13 wherein the grip part is pivotable relative to the tool part to be perpendicular with the axis of rotation.

* * * * *

UNITED STATES PATENT AND TRADEMARK OFFICE

CERTIFICATE OF CORRECTION

PATENT NO. : 6,101,909

DATED : August 15, 2000

INVENTOR(S) : Johan Eric Djie

It is certified that error appears in the above-identified patent and that said Letters Patent is hereby corrected as shown below:

Col. 4, line 53, delete "(4,5)" and "(1)".

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*